US008223026B2

(12) United States Patent
Cole

(10) Patent No.: US 8,223,026 B2
(45) Date of Patent: Jul. 17, 2012

(54) BLANKET FOR PROTECTING A CEILING FROM MOISTURE

(76) Inventor: Harold W. Cole, Corcoran, CA (US)

( * ) Notice: Subject to any disclaimer, the term of this patent is extended or adjusted under 35 U.S.C. 154(b) by 810 days.

(21) Appl. No.: 12/218,966

(22) Filed: Jul. 21, 2008

(65) Prior Publication Data

US 2010/0180522 A1 Jul. 22, 2010

(51) Int. Cl.
*G08B 21/00* (2006.01)

(52) U.S. Cl. ..... 340/604; 340/605

(58) Field of Classification Search ..... 340/604–605; 73/171

See application file for complete search history.

(56) References Cited

U.S. PATENT DOCUMENTS

| | | | | |
|---|---|---|---|---|
| 3,407,556 | A | 10/1968 | Leibrook | |
| 3,720,031 | A | 3/1973 | Wilson et al. | |
| 4,502,044 | A * | 2/1985 | Farris et al. | 340/604 |
| 4,633,899 | A | 1/1987 | Lord | |
| 4,707,960 | A | 11/1987 | Bullock | |
| 4,977,721 | A | 12/1990 | Blosseville et al. | |
| 5,133,167 | A | 7/1992 | Drew et al. | |
| 5,172,718 | A | 12/1992 | Thornburgh | |
| 5,299,591 | A | 4/1994 | Duncan | |
| 5,637,105 | A * | 6/1997 | Tanaka et al. | 604/368 |
| 5,977,721 | A * | 11/1999 | Nilssen | 315/205 |
| 6,625,933 | B1 | 9/2003 | Moeller | |
| 6,704,681 | B1 * | 3/2004 | Nassof et al. | 702/132 |
| 2007/0044231 | A1 * | 3/2007 | Ball | 4/689 |
| 2007/0044236 | A1 * | 3/2007 | Tatsuno | 5/420 |

* cited by examiner

*Primary Examiner* — Shirley Lu
(74) *Attorney, Agent, or Firm* — Richard L. Mikesell

(57) ABSTRACT

A water-absorbent blanket that is located between a roof and the ceiling of a building, such as a residence, to catch and absorb any water that may leak through the roof or which is a result of condensation and prevent that water from reaching a finished ceiling.

9 Claims, 1 Drawing Sheet

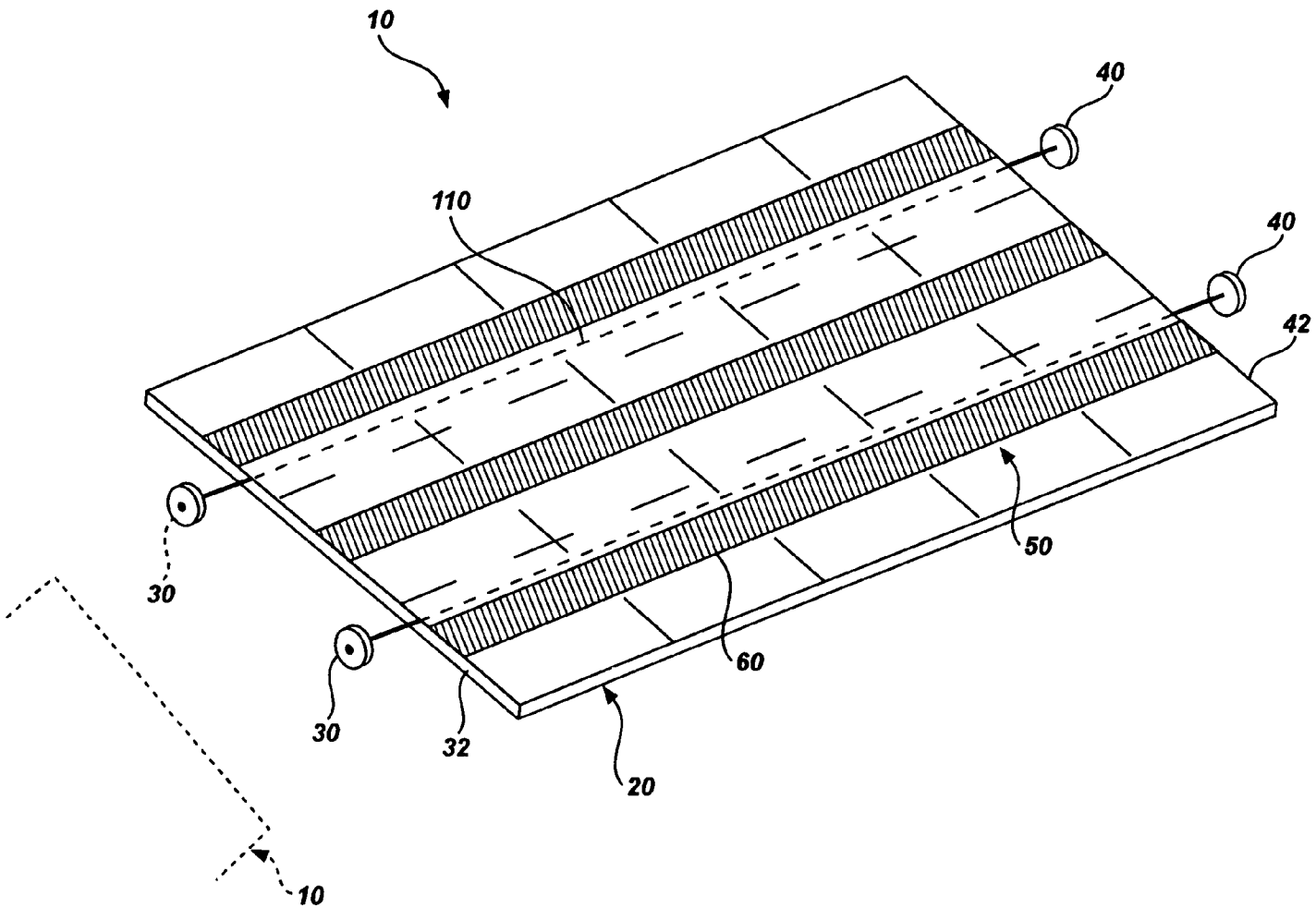
10
110
40
40
42
50
60
20
32
30
30
10

BLANKET FOR PROTECTING A CEILING FROM MOISTURE

TECHNICAL FIELD OF THE INVENTION

The present invention relates in general to static structures, such as buildings or residences, and in particular to protecting the interior ceilings of those structures from adverse effects associated with moisture in an attic of the structure.

BACKGROUND OF THE INVENTION

Leaky roofs can be a pernicious problem. Even if one doesn't see signs of a roof leak in the rooms below the attic, it is possible that the water is collecting in the attic insulation or running into unseen areas like the wall cavities.

Water impinging on the ceiling of a building can be caused by means other than a leaky roof. For example, a chimney is often a source of leaks because the masonry and roof surfaces expand and contract at different rates with fluctuations in temperature. Gaps frequently open up as the surfaces pull away from each other. Builders try to prevent this by installing flashing, thin sheets of flexible metal, between the roof and chimney. If the flashing is correctly installed, it should come up the sides of the chimney and fold into the mortar joints between the chimney bricks.

Flashing leaks occur around the chimney if the flashing deteriorates or if the top edge was not correctly inserted into the mortar joints. High-grade urethane roof sealant can be injected into the gaps around the chimney. Over time, however, the gaps will open up again and the roof will leak again.

Another source of such water is condensation. If a surface is at a temperature that is below the dew point of the ambient air. In such a case, water will collect on the surface. As that water collects, it may drip off the surface. Such water may fall onto the ceiling of a building if the surface is in the attic. Such surfaces include pipes, equipment as well as the building walls and underside of the roof.

In building structures having overhead supported, suspended ceiling panels, significant damage can result from fluid leaks that may develop above a ceiling panel arrangement. Typically, ceiling panels are manufactured from compressed fibrous or the like materials and have interstitial spaces for improved sound absorption. Such arrangement of material typically tends to absorb fluids and typically fluid flowing onto ceiling panels manufactured from such materials saturates a first panel which in turn can cause fluid flow to adjacent panels such that several panels can become wetted and stained from a single above-ceiling leak source.

Eventually the fluid can flow through the ceiling panel or panels and drain downwardly to an area under the ceiling. Typically when fluid wets through such ceiling panel, it drains from more than one location on the surface of the panel and may even shift locations depending upon the amount of fluid being drained and the flow patterns that develop within the panel. Because of the inconsistent and multiple locations of fluid drainage the collection of the draining fluid can be problematical and the protection of valuables under the ceiling becomes difficult.

When a leak occurs in a place of business, such as an office, store or warehouse, the leaking fluid is often channeled by pipes, duct work, ceiling structure, etc., so that fluid from a single leak will drip onto a room's contents from more than one ceiling location. Although the amount of fluid flowing from a ceiling leak may not be great, leaking fluid is especially disruptive to businesses. Electronic equipment such as computer and communications equipment are especially sensitive to damage by liquids. Inventory stored below a leaking ceiling can be damaged beyond repair. Damage can also occur to inventory as well as works of art or the like that are often located inside buildings. Office workers cannot work in a leaking room. Office files and records may be damaged beyond the ability of a business to recover.

In addition to the above-discussed damage, a leaky roof may lead to water collection in the attic, and such water collection may lead to standing water. Standing water may be a source of toxic mold. Toxic mold can be exacerbated by darkness and poor ventilation. It is more common in buildings constructed after the 1970s, which are more airtight, and is more likely to occur in buildings with persistent water leaks. While water damage to equipment and the building is quite undesirable, toxic mold can be dangerous and can be lethal in some instances. In fact, some cases of toxic mold may require total destruction of the building. Thus, water infiltration into a building is not only undesirable, it is imperative that it be taken care of if toxic mold is a possibility.

When ceiling leaks occur, it is the usual practice to place a pot, pail, bucket or other receptacle under the leak in order to catch the dripping water. If the leak takes the more usual form of dripping from spaced points, a number of receptacles are required. This is generally found to be an ineffective remedy since the receptacle must be constantly attended and frequently emptied to prevent overflowing. Further, if the leak tends to grow wider or be channeled to new locations, some of the dripping liquid will miss the positioned receptacle.

Therefore, there is a need for a means for preventing moisture that may be present in an attic of a static structure, such as a building or a residence, from contacting the ceiling of that structure.

SUMMARY OF THE INVENTION

These, and other, objects are achieved by a blanket that can be unfurled in the attic space of a static structure between a roof and a ceiling to absorb water that has either leaked through the roof or has been otherwise generated above the ceiling. The blanket is formed by a plurality of individual units that are releasably coupled together. Each unit includes a base formed of water-absorbing material. One form of the invention includes visual and/or audible alarms when the materials in the blanket becomes damp so a building manager will be alerted to the presence of moisture in the attic.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURE

The invention can be better understood with reference to the following drawing and description. The components in the figure are not necessarily to scale, emphasis instead being placed upon illustrating the principles of the invention. Moreover, in the figures, like referenced numerals designate corresponding parts throughout the view.

FIG. 1 is a perspective view of a unit which is included in the ceiling-protecting blanket embodying the principles of the present invention.

DETAILED DESCRIPTION OF THE INVENTION

Referring to the figure, it can be understood that the present invention is embodied in a blanket which is located in an attic of a static structure, such as building or a residence or the like, so it is interposed between the roof of the structure and the ceiling of that structure. The blanket will thus be positioned to intercept moisture that is located in the attic before that moisture reaches the ceiling, which may be a finished ceiling. As will be understood from the teaching of this disclosure, the blanket is designed to absorb that moisture. As will also be understood, the blanket has means for generating a signal that will alert a homeowner or a property manager of the presence of moisture.

The blanket is formed of a plurality of individual units 10 each of which is positioned in an attic of a building between the ceiling of the building and the roof of the building for protecting the ceiling of a building from moisture which may be present in the attic either due to leaks in the roof or due to condensation. All of the units are identical, and each unit 10 comprises a flexible base 20 that is located in an attic of a building between a roof of the building and the ceiling of a room within the building when in use. Base 20 includes moisture-absorbing materials so that moisture which would otherwise impinge on the ceiling will be absorbed by the unit 10.

A ceiling will be covered by a blanket formed of a plurality of units 10. Therefore, each unit 10 further includes coupling elements on the base for releasably coupling the base to adjacent bases. The releasable coupling permits removal of a damaged unit and replacement thereof without requiring removal of an entire blanket.

The coupling elements can include snaps 30 located on one end edge 32 of base 20 and snap-accommodating elements 40 located on another end edge 42 of the base. The snaps and the snap-accommodating elements are located so that snaps on one base will be accommodated in snap-accommodating elements of an adjacent base. Other releasable coupling means, such as hook-and-loop elements, or the like, can be used without departing from the scope of the present disclosure.

A blanket is formed by coupling a plurality of the units together by means of the coupling elements on each base. An adjacent unit is indicated in the figure by dotted lines.

Unit 10 also includes alarm elements 50 embedded in the base. The alarm elements are sensitive to moisture and which generate an alarm signal when moisture in the base reaches a preset level. In the form of the invention shown, the alarm elements include an element 60, such as moisture-sensitive paint which changes color when moist and thereby generates a visual alarm signal when moisture has contacted unit 10. Unit 10 can also include circuitry which includes wires 70 embedded in base 20. The circuitry associated with wires 70 will generate a signal, either visual or audible, when a wire is contacted by moisture. The embedded wires are electrically connected to the coupling elements in a manner which completes a circuit through the entire blanket. Such circuitry is known to those skilled in the art, and the details of the circuitry are not important to this invention. As such the details of the circuitry will not be discussed or claimed.

The alarm elements can be used individually or in combination as suitable.

The absorbent material in the units can be a hygroscopic material which can be made out of a mixture of cellulose pulp together with super absorbent polymers. Another material sodium polyacrylate. Desiccants and various deliquescent compounds may be used to enhance the efficiency of the liner embodying the principles of the present invention. Deliquescent salts include calcium chloride, magnesium chloride, zinc chloride, and carnallite as well as other such chemicals as will occur to those skilled in the art based on the teaching of the present disclosure.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A unit for protecting a ceiling of a building from moisture: said unit being that located in an attic of a building between a roof of the building and the ceiling of a room within the building when in use, said unit comprising a flexible base containing moisture absorbing materials;

each base including alarm elements which are sensitive to moisture and which generate an alarm signal when moisture in that base reaches a preset level; and coupling elements on the aforesaid flexible base for releasably coupling the aforesaid unit to adjacent similar units;

wherein the coupling elements include snaps on one end edge of the base and snap-accommodating elements on another end edge of the base and located in position to mate with snaps on an adjacent base.

2. The unit for protecting a ceiling defined in claim 1 wherein the alarm elements include an element which generates a visual alarm signal.

3. The unit for protecting a ceiling defined in claim 1 wherein the alarm elements include an element which generates an audible alarm signal.

4. The unit for protecting a ceiling defined in claim 2 wherein the alarm elements include an element which generates an audible alarm signal.

5. The unit for protecting a ceiling defined in claim 1 wherein the moisture-absorbing material includes a hygroscopic material.

6. The unit for protecting a ceiling defined in claim 1 wherein the moisture-absorbing material includes sodium polyacrylate.

7. The unit for protecting a ceiling defined in claim 1 wherein the moisture-absorbing material includes a desiccant material.

8. The unit for protecting a ceiling defined in claim 1 wherein the moisture-absorbing material includes deliquescent salts.

9. The unit for protecting a ceiling defined in claim 1 wherein the coupling elements include snaps on one end edge of the base and snap-accommodating elements on another end edge of the base and located in position to mate with snaps on an adjacent base.

* * * * *